US005795246A

United States Patent [19]

Hale

[11] Patent Number: 5,795,246

[45] Date of Patent: Aug. 18, 1998

[54] GOLF PUTTER

[76] Inventor: Robert L. Hale, 3424 Wayne Rankin Rd., Louisville, Tenn. 37777

[21] Appl. No.: 840,143

[22] Filed: Apr. 11, 1997

[51] Int. Cl.[6] ..... A63B 53/04

[52] U.S. Cl. ..... 473/340; 473/314

[58] Field of Search ..... 473/305, 306, 473/307, 308, 309, 313, 314, 324–350

[56] References Cited

U.S. PATENT DOCUMENTS

| | | | |
|---|---|---|---|
| 2,478,468 | 8/1949 | Drake . | |
| 4,871,174 | 10/1989 | Kobayashi . | |
| 5,267,733 | 12/1993 | Szokola . | |
| 5,382,019 | 1/1995 | Sneed | 473/314 |
| 5,439,222 | 8/1995 | Kranonborg . | |
| 5,458,332 | 10/1995 | Fisher | 473/340 |
| 5,544,879 | 8/1996 | Collins | 473/314 |
| 5,630,765 | 5/1997 | Moore | 473/340 |

OTHER PUBLICATIONS

Unknown, The New Putters, Golf Equipment Buyer's Guide, pp. 76–79, 1997 Annual, Werner Publishing Corp. USA.

*Primary Examiner*—Steven B. Wong
*Attorney, Agent, or Firm*—Robert M. Poteat PC

[57] ABSTRACT

A improved golf putter includes a putter head that has a flat generally elliptical shaped front striking surface having a major axis extending between a toe and heel ends of the putter head and a rearwardly extending body portion having a convex generally ellipsodial form. The putter head is connected to the lower end of an elongated shaft having an upper grip end through a neck member that has a lower arcuate portion having a linear end leg connected to the body portion at the rearward most extension thereof in alignment with an axis passing through the center of the front striking surface and the center of gravity of the putter head and an upper portion connected to the opposite end of the elongated shaft so that the longitudinal axis of the elongated shaft is aligned parallel to the plane of the striking surface of the putter head and offset therefrom sufficient to form a line of sight plane along a front edge of the elongated shaft coextensive with the plane of the striking surface of the putter head.

11 Claims, 1 Drawing Sheet

GOLF PUTTER

BACKGROUND OF THE INVENTION

1. Technical field

The present invention relates to improvements in golf putters, and more particularly, to an improved golf putter that assures proper alignment of the club head with respect to the true path of the ball to the hole.

2. Discussion of the Prior Art

There are a myriad of golf putter designs in the golf club fine. Each attempts to deal with the proper alignment of the putter face with the golf ball such that when the putter face strikes the ball at the effective center of mass or "sweets pot" of the putter head the line of travel of the struck ball will follow a predetermined line of travel to the hole. To this end putter designs, operating on this theory, have varied from the simple to the most complex designs. By far the preponderance of prior art putter designs utilize a putter head that is attached to the shaft at substantially one end of the putter head. Representative of these prior putters are those shown in an article in the 1997 annual Golf Equipment Buyer's Guide, pp. 76–79. All of these designs suffer from the problem that when the ball is struck with the putter head there is a tendency for the head to rotate about the axis of the shaft during the swing of the club, making it very difficult to keep the putter head normal to the intended line of travel of the golf ball. This problem is due to the torque applied to the shaft by the offset of the putter head striking point from the shaft attachment point.

Various putter designs have attempted to overcome this rotational problem by adding weights to the toe and heel of the putter head. Typically, these putter designs utilize elaborate balancing schemes to achieve zero torquing or rotation of the putter head about the shaft axis. One such prior art putter is shown in U.S. Pat. No. 4,871,174, issued Oct. 3, 1989, to M. Kobayashi for "Golf Club." This design utilizes a thin face plate having a generally flat front hitting surface and generally flat back surface extending substantially parallel to the front face. A pair of rod-like bodies are rigidly attached to the back surface at the heel and toe ends of the putter head to distribute the weight therebetween. The placement of the rod-like bodies at the heel and toe ends minimizes rotation of the putter head about the center axis of the shaft.

Another design that minimizes rotation of the putter head about the center axis of the shaft is shown in U.S. Pat. No. 5,439,222, issued Aug. 8, 1993, to C. Kranonborg for "Table Balanced, Adjustable Moment of Inertia, Vibrationally Tuned Putter." This design, which utilizes a front striking face and rear face that forms a configuration commonly called a "blade" type putter, provides for adjustable toe and heel weights to be positioned behind the front striking face of the putter head such that the putter's mass is equally bisected by a vertical plane intersecting the heel and toe regions of the putter head, as well as the longitudinal axis of the shaft. While this blade putter achieves a table balanced configuration, it requires the placement of machined weight chambers in the rear face to accommodate separate machined heel and toe weight plugs.

A still further "blade" type putter is shown in U.S. Pat. No. 5,267,733, issued Dec. 7, 1993, to D. Szokola for "Golf Putter." This design has heel and toe regions that form a rear interior cavity with the back wall opposed to the front striking plate. This design places a greater percentage of the overall weight of the club head at the opposed heel and toe sides, thereby minimizing any tendency to open or close the striking face of the club head with respect to the golf ball during swing. This design also utilizes an arcuate section connected between the elongated shaft and the putter head hosel of sufficient length such that when the end of the leg is connected to the hosel the striking face of the club head is spaced from the longitudinal axis of the shaft a distance equal to the radius of a golf ball. The hosel is centered between the top surface and the sole of the club head and is further centered between the lateral sides of the toe and heel regions of the club head.

Another prior putter is shown in U.S. Pat. No. 2,478,468, issued Aug. 9, 1949, to J. Drake for "Golf Putter." While this putter attaches the putter shaft at the rear of the putter head, it requires a curved flange member formed integrally with the lower edge of the putter head and extending rearwardly to form a cavity and a grounding surface. It also provides a shaft offset that positions the front surface of the putter head forward of the plane of the putting shaft.

While these prior art putters address the rotational problem, the solution to this problem is at the expense of simplicity of design. In an attempt to reduce the tendency of these type putters to rotate about the axis of the shaft and increase the sweet spot of the putter head, the designs have resorted to placing individual weights in the heel and toe regions or increasing the mass in these regions of the putter head or providing an integrally formed grounding surface at the lower edge of the putter head. This introduces a high degree of complexity to the putter design, especially in the manufacture of the putter.

Thus, it will be seen that there is a need to provide a golf putter that has a simplified design that assures that the golf ball is struck in the sweet spot of the putter head, while eliminating the tendency of the putter head to rotate about the shaft axis. Further, there is a need to provide a golf putter that aids in the visual alignment of the putter head with the golfball and the intended path of the ball to the hole. Also, there is a need to provide a simplified golf putter that facilitates the manufacturing process.

SUMMARY OF THE INVENTION

In accordance with the present invention, there is provided a golf putter having a putter head that has a flat generally elliptical shaped front striking surface with a major axis extending between a toe and heel ends of the putter head and a rearwardly extending body portion having convex generally ellipsodial form. The putter head is connected to the lower end of an elongated shaft having an upper grip end through a neck member that has a lower arcurate portion having a linear end leg connected to the body portion at the rearward most extension thereof in alignment with an axis passing through the center of the front striking surface and the center of gravity of the putter head and an upper portion connected to the opposite end of the elongated shaft so that the longitudinal axis of the elongated shaft is aligned parallel to the plane of the striking surface of the putter head and offset therefrom sufficient to form a fine of sight plane along a front edge of the elongated shaft coextensive with the plane of the striking surface of the putter head. This configuration greatly aids in the proper alignment of the putter head with respect to the golfball and the true line of travel of the ball to the hole by assuring that the ball is struck at the center of gravity of the putter head; thus, eliminating any tendency for the putter head to rotate about the shaft axis.

BRIEF DESCRIPTION OF THE DRAWING

These and other objects, features and advantages of the present invention will become more apparent to those skilled in the art by referring to the accompanying drawings in which.

DESCRIPTION OF THE PREFERRED EMBODIMENTS

With specific reference to the drawings and in particular FIGS. 1–5, there is depicted a golf putter according to the present invention which includes a conventional elongated shaft 1 having a grip end and an opposite end 2. The material of construction of the shaft may be one of a number of different types of shafts well known to those skilled in the art of manufacturing golf clubs and may be constructed of any suitable material, such as steel, graphite, composites, wood or any combination thereof. The shaft may be hollow, or solid and may have a constant cross-section or it may be provided with a tapered configuration which has a gradual decreasing diameter from the hand grip to the opposite end 2.

Figure 1:
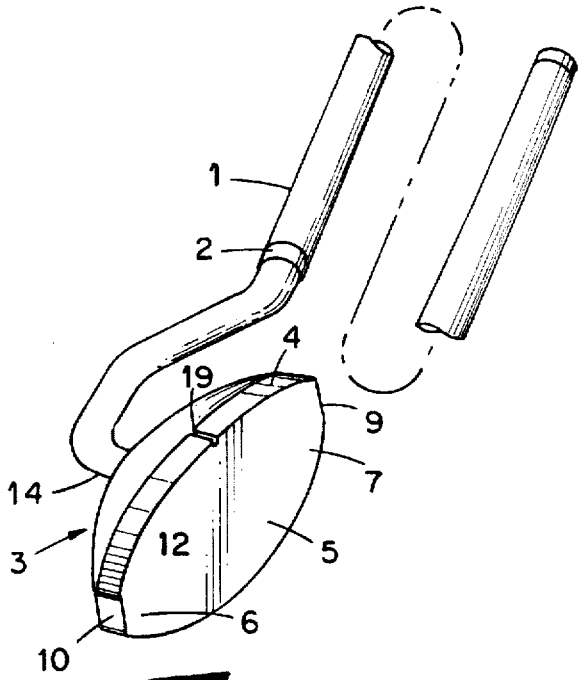
FIG. 1 is a perspective view of a golf putter constructed in accordance with the present invention.
Figure 2:
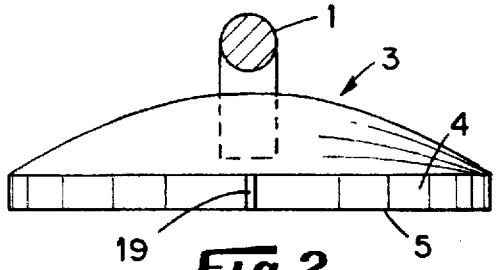
FIG. 2 is a top view of the golf putter shown in FIG. 1.
Figure 3:
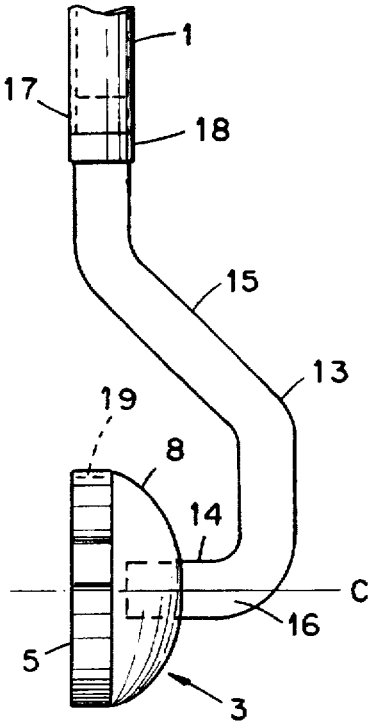
FIG. 3 is a right side view of the golf putter shown in FIG. 1.
Figure 4:
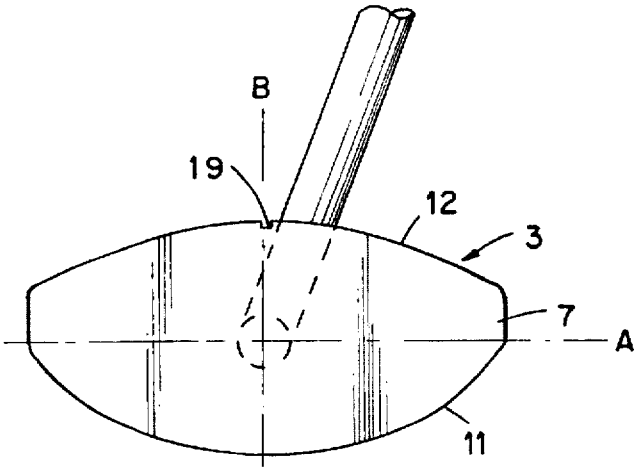
FIG. 4 is a front view of the golf putter shown in FIG. 1.

The golf putter (FIG. 1) has a putter head 3 that includes a face portion 4 having a flat, generally elliptical shaped front striking surface 5 with a major and minor axis A and B, as shown in FIG. 4 extending between parallel toe end 6 and heel end 7 of the putter head 3 and a rearwardly extending body portion 8 having a convex, generally ellipsoidal form, as best shown in FIGS. 2 and 3. This design has been found to concentrate the center of gravity of the putter head that is aligned with the center of the putter head striking surface 5. The elliptical shaped front face portion 4 has a uniform thickness. It is preferred that the face portion have a uniform thickness of no greater than 0.25 inches and have parallel edge surfaces 9 and 10 coextensive with the thickness of the elliptical shaped front striking surface 5 and perpendicular to the plane of the striking surface of the putter head 3. The thickness of the face portion 4 forms a curved lower grounding surface 11 and an upper curved edge surface 12 as best shown in FIG. 4. The curved slope of the lower grounding surface 11 prevents snagging during a putting stroke.

The golf putter (FIG. 3) is provided with a neck member 13 (shown rotated 20° for clarity) that has a lower linear end leg 14 that is rigidly attached to the body portion 8 of putter head 3 at the rearward most extension thereof in alignment with an axis C passing through the center of the front portion 4 and the center of gravity of the putter head 3. Neck member 13 has an upper, dual angled portion 15 connected to opposite end 2 of shaft 1 and a lower arcuate portion 16 so that the longitudinal axis of shaft 1 is aligned parallel to the plane of striking surface 5 of putter head 3 and offset therefrom sufficient to form a fine of sight plane along a front, edge 17 of shaft 1 coextensive with the plane of striking surface 5 of putter head 3.

In a preferred embodiment neck member 13 is a mild steel round rod and may be formed, for by example, by forging an upset cross-section at one end. The upset section provides excess material to form a shoulder 18 to match the outside diameter of shaft 1. Shoulder 18 may be machined to reduce its diameter to one that matches the inside diameter of shaft 1. This provides a suitable transition between the outside diameter of shaft 1 and the outside diameter of neck member 13. The configuration of neck member 13, in accordance with this invention is, preferably, formed by bending a first segment into a right hand 45° bend, then a left hand 45° bend, followed by a 90° bend to form end leg 14.

Preferably, the longitudinal axis of shaft 1 is disposed at an angle of about 20° from the minor axis B of the front striking surface 5 of putter head 3. This configuration provides a visual aid in the proper alignment of the golf ball with the putter head 3 by providing for the simultaneous viewing of the front striking surface 5, an alignment groove 19 cut in the upper curved edge of surface 12 along a longitudinal axis parallel to the linear end leg 14, and the cylindrical outline of neck member 13.

The design of the putter of the present invention greatly facilitates the manufacturing process. In a preferred embodiment the putter head is made out of steel and by configuring the putter head in a generally elliptical shape, conventional metal forging methods for forming steel ingots into a final finished form may be readily used to produce the putter head. Other metal working methods may also be used to produce the putter heads in accordance with the configuration of the present invention.

Figure 5:
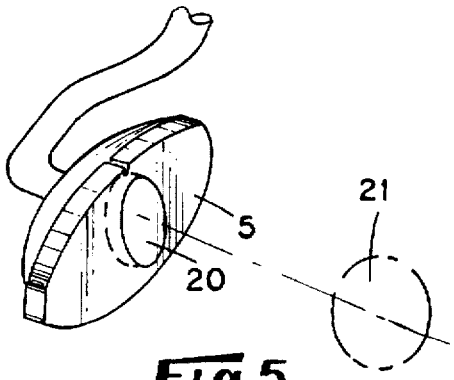
FIG. 5 is a perspective view of a golf putter illustrating a second embodiment of the present invention which includes an insert disc flush-mounted in the surface of the putter.

Another embodiment of the golf putter of the present invention is shown in FIG. 5. In this embodiment, an insert 20 is embedded in the elliptical shaped front striking surface 5 so that the insert will be aligned with the center line of a golf ball 21 to be struck by the putter. Since golf ball covers have gotten much harder, it has become slightly advantageous to use inserts formed of resilient material. Putters inserts provide for longer dwell time (i.e., the length of time that the putter and the ball are together), help to reduce skid time, and increase the sensitivity and touch of the putter, especially on fast greens. Those skilled in the art will recognize that the insert can't be too soft and must be, preferably, as hard or harder than typical Surlyn-covered golf ball. Suitable materials of construction of insert 20 are readily available on the commercial market and may be compounds selected from the group consisting of polyester elastomers, nylon resin, and acetal resins. Insert 20 should be of a sufficient thickness to permit the golfer to hit the ball with a regular putting stroke on fast greens and preferably is of a uniform thickness of no greater than 0.25 inches. Insert 20 should also be of a shape that permits the golfball 21 at impact to fully contact its surface and preferably is of a circular configuration having a diameter of at least one inch.

It will be understood, of course, that various modifications may be made in the embodiments of the invention illustrated and described herein without deviating from the scope and purview of the invention as defined by the appended claims.

What is claimed is:

1. A golf putter comprising:

an elongated shaft having a grip end and an opposite end;

a putter head including a face portion having a flat, generally elliptical shaped front striking surface with a major axis thereof extending between a toe and heel ends of said putter head and a rearwardly extending body portion having a convex, generally ellipsoidal form to provide a concentrated center of gravity of said putter head aligned with the center of said putter head striking surface; and a neck member having a lower arcuate portion having a linear end leg connected to said body portion of said putter head at the rearward most extension thereof in alignment with an axis passing through the center of said front striking surface and the center of gravity of said putter head and an upper portion connected to said opposite end of said shaft so that the longitudinal axis of said shaft is aligned parallel to the plane of said striking surface of said putter head and offset therefrom sufficient to form a line of sight plane along a front edge of said shaft coextensive with the plane of said striking surface of said putter head.

2. The golf putter as set forth in claim 1 wherein said face portion of said putter head has a uniform thickness of no greater than about 0.25 inches and includes parallel edge surfaces coextensive with the thickness of said face portion and perpendicular to the plane of said striking surface of said putter head forming a curved lower grounding surface and an upper curved edge surface on a surface opposite said grounding surface.

3. The golf putter as set forth in claim 2 wherein the upper edge surface of said putter head includes an alignment groove extending perpendicular to said striking surface of said putter head and along a longitudinal axis parallel to said linear end leg of said neck member to provide alignment of said putter head along a desired path of travel of a golf ball to be struck by said putter head.

4. The golf putter as set forth in claim 3 wherein the longitudinal axis of said shaft and said neck member are disposed in a single plane perpendicular to the plane of said face portion of said putter head and at an angle with respect to a minor axis of said elliptical face portion of said putter head.

5. The golf putter as set forth in claim 4 wherein said longitudinal axis of said shaft is disposed at an angle of about 20 degrees from said minor axis of said elliptical face portion of said putter head.

6. The golf putter as set forth in claim 1 wherein said face portion and said rearwardly extending body portion are formed of an integral metal forging.

7. The golf putter as set forth in claim 2 wherein the edges of said face portion of said putter at said heel and toe ends thereof are in separate parallel planes perpendicular to said major axis of said elliptical face portion of said putter head.

8. The golf putter as set forth in claim 2 further including an insert flush-mounted in said striking surface of said face portion, said insert having a center axially disposed with said axis passing through the center of said front striking surface and the center of gravity of said putter head and being of a sufficient thickness to cushion the force imparted by said putter head when striking said golf ball.

9. The golf putter as set forth in claim 8 wherein said insert is formed of one of polyester elastomers, nylon resins and acetal resins.

10. The golf putter as set forth in claim 9 wherein said insert is a circular disc.

11. The golf putter as set forth in claim 10 wherein said disc is of a thickness no greater than about 0.25 inches and its diameter is approximately one inch.

* * * * *